US005122193A

United States Patent [19]

Derlein

[11] Patent Number: 5,122,193

[45] Date of Patent: Jun. 16, 1992

[54] PIPE CLEANING MODULES AND SYSTEMS AND METHODS FOR THEIR USE

[75] Inventor: Donald A. Derlein, Albuquerque, N. Mex.

[73] Assignee: Albuquerque Underground, Inc., Albuquerque, N. Mex.

[21] Appl. No.: 567,309

[22] Filed: Aug. 10, 1990

[51] Int. Cl.[5] ..... B08B 9/02; B08B 9/087

[52] U.S. Cl. ..... 134/22.11; 134/22.12; 134/23; 134/167 C; 15/104.31

[58] Field of Search ..... 134/10, 21, 22.11, 22.12, 134/23, 166 C, 167 C, 168 C, 169 C; 15/104.31

[56] References Cited

U.S. PATENT DOCUMENTS

| | | | |
|---|---|---|---|
| 2,465,921 | 3/1949 | Peters | 134/8 |
| 2,735,122 | 7/1953 | Pletcher | 15/104.31 |
| 2,858,556 | 11/1958 | Van Der Lans | 15/104.3 |
| 3,004,278 | 10/1961 | Stanley | 15/319 |
| 3,181,192 | 5/1965 | Truman | 15/104.3 |
| 4,418,437 | 12/1983 | French | 15/104.09 |
| 4,473,921 | 10/1984 | Weber et al. | 15/304 |
| 4,475,260 | 10/1984 | Beck | 15/104.31 |
| 4,520,524 | 6/1985 | Long, Jr. | 15/104.31 |
| 4,578,198 | 3/1986 | Schmidt et al. | 134/22.12 |
| 4,657,449 | 4/1987 | Marich | 409/143 |
| 4,773,115 | 9/1988 | Smith | 15/104.12 |

FOREIGN PATENT DOCUMENTS

| | | |
|---|---|---|
| 191908 | 8/1919 | Fed. Rep. of Germany . |
| 192906 | 6/1929 | France . |

*Primary Examiner*—Theodore Morris
*Assistant Examiner*—Saeed Chaudhry
*Attorney, Agent, or Firm*—Deborah A. Peacock; Donovan F. Duggan

[57] ABSTRACT

A sewer cleaning module for cleaning sewer pipes in preparation for relining. The module is assembled in situ and the relative size of components is selected depending upon the diameter of the pipeline. The module may comprise a front unit and rear unit or a frame assembly and a drive assembly. The modules contain a motor, preferably a hydraulic motor. The motor drives flails, thereby disintegrating solid waste or generating and propelling a sludge slurry. The slurry scours the pipeline walls by cavitation and abrasion action. Also disclosed are systems for cleaning a sewage line section and methods of their use.

17 Claims, 16 Drawing Sheets

PIPE CLEANING MODULES AND SYSTEMS AND METHODS FOR THEIR USE

BACKGROUND OF THE INVENTION

1. Field of the Invention (Technical Field)

The invention relates to modular pipe cleaning apparatuses particularly useful for sewage lines enabling non-disruptive cleaning and relining preparation, and systems and methods for their use.

2. Description of the Related Art Including Information Disclosed under 37 C.F.R. §§1.97–1.99 (Background Art)

The sewage cleaning art is replete with devices, either towed or self-propelled, for cleaning the interior of sewer pipes. Such cleaning is periodically necessary to remove accumulated sludge and sediment. Further, sewer pipe cleaning forestalls the corrosion of concrete sewer pipes by removing the hydrogen sulfide reactant in the formation of sulfuric acid, which actively attacks such concrete pipes.

One means of preventing further corrosive attack of concrete pipes is the installation of polyethylene slip liners within the pipes. These liners resist sulfuric acid corrosion and can extend the active life of the sewer pipe an estimated one hundred to one hundred fifty years.

Prior to installation of slip liners, the sewer line must be thoroughly cleaned. All sludge and sediment must be removed from the pipe channel itself. Further, and of more concern, deleterious scale deposits built up upon the brittle concrete pipes themselves must be removed without damage to such pipes.

U.S. Pat. No. 2,465,921 to Peters, entitled Method of Cleaning Flues, discloses a method of cleaning flues comprising power driven flexible brushes and chains.

U.S. Pat. No. 3,004,278, to Stanley, entitled Pipe Cleaning Apparatus, teaches a self-propelled pipe cleaning apparatus comprising a power driven rotatable head supported by idler wheels.

U.S. Pat. No. 4,473,921, to Weber, et al., entitled Cleaning Device for the Internal Peripheral Surfaces of Pipelines or Hollow Cylindrical Vessels, Especially for Manipulators for the Interior of Pipes, teaches a pipeline cleaning apparatus comprising several "heads" connected by universal joints.

French Patent FR 667,610 ; and German Patent DT 314,059 also appear to disclose pipeline cleaning devices.

U.S. Pat. No. 3,181,192, to Truman, entitled Bucket for Sewer Cleaning, discloses a clam shell type bucket for removing limited amounts of sediment and sludge by being dragged through a sewer line. U.S. Pat. No. 2,858,556, to Van der Lans, entitled Self-Propelled Sewer Pipe Cleaning Apparatus, teaches a self-propelled sewer cleaning apparatus having a retractable flap for cleaning the bottom of the pipe channel.

U.S. Pat. No. 4,418,437, to French, entitled Pipe Cleaning Apparatus, discloses self-propelled pipe bore cleaning apparatus having hydraulic jacks. U.S. Pat. No. 4,657,449, to Marich, et al., entitled Internal Sewage Line Stub Cutting Tool Having Automatic Bit Adjustment, discloses a towed device for cutting stub pipes in a sewer line. U.S. Pat. No. 4,773,115, to Smith, entitled Sewer Cleaning Device, teaches a sewer cleaning device which is periodically hydraulically locked in position in a sewer line to cut away obstructions.

The present invention provides several embodiments of sewer cleaning modules. The preferred embodiment provides a sewer cleaning module designed to dredge heavy compacted sewer sludge. An alternative embodiment primarily provides scale deposit removal.

SUMMARY OF THE INVENTION DISCLOSURE OF THE INVENTION

The invention relates to modular pipe cleaning apparatuses, systems incorporating such apparatus, and methods for using the apparatus and the systems. The present invention is particularly useful for cleaning sewer lines.

The preferred pipe cleaning module comprises a main unit or a forward unit and a rear unit fittable into the pipe, and a hinge assembly connecting the forward unit and the rear unit. The forward unit contains a motor, whereas the rear unit contains a pump. The forward unit and rear unit comprise arcuate segments, circumferentially secured to one another. The forward unit comprises a yoke, with a longitudinally extending tongue and a connector detachably engaged by a crossbar. The crossbar has a towing cable attachment. The forward unit also comprises a slurry agitating mechanism, such as a plurality of flails. These flails are driven by the motor disposed in the forward unit.

In an alternative embodiment, the invention comprises a forward unit for a pipe cleaning module, an annulus having forwardly projecting teeth; a vibrator mechanism for vibrating the annulus; a towing harness attached to the annulus and extending forwardly of the annulus; and a cable attached to the annulus and extending rearwardly of the annulus. The annulus comprises a plurality of toothed arcuate segments, with skids and fins. Alternate ones of the plurality of toothed arcuate segment means comprise fore-and-aft staggered apertures and the towing harness and cable are attached to the fore-and-aft staggered apertures.

An alternative embodiment of the invention comprises a sewer cleaning module adapted to clean a sewage line section. The module comprises a frame assembly having a plurality of preformed segmental support members interconnected by longitudinally extending ribs; a plurality of flap valves mounted peripherally about one end of the frame assembly; a drive assembly mounted coaxially with the frame assembly, the drive assembly having a motor and shaft; and the shaft being eccentrically mounted relative to the sewage line section.

In another alternative embodiment, the plurality of preformed segmental support members are circumferentially secured to each other. The frame assembly includes a yoke comprising slidable longitudinally extending members detachably engaged by a crossbar at one end thereof. The longitudinally extending members are slidably and pivotally mounted in lateral journal bearings and are detachably secured to the frame assembly at the other end thereof. The crossbar includes a towing cable attachment and locking means thereon.

Another alternative embodiment of the sewer cleaning module comprises a plurality of cutters mounted proximate to the flap valves.

Yet another alternative embodiment of the invention comprises the drive assembly mounted within the frame assembly.

Preferably, the drive assembly comprises a plurality of nozzles at one end thereof. The drive assembly preferably comprises a slotted housing adapted to be secured to the frame assembly. The slotted housing preferably comprises an access port and a vent at the other end thereof.

The preferred embodiment of the drive assembly comprises a motor operatively connected to a shaft by gears. Preferably, the motor is a hydraulic motor; alternatively, the motor may be an electric or pneumatic motor. Preferably, the hydraulic motor includes hoses, manifolds, flow dividers, a pump, and an accumulator in circuit therewith. The pump is adapted to pump liquid sewage through the nozzle.

In an alternative embodiment, an output shaft is concentrically mounted on and secured to the shaft by a shear pin. Preferably, the output shaft means comprises flails and an impeller mounted thereon. Alternatively, the output shaft may comprise cutters mounted thereon.

The preferred embodiment of the invention further provides a method of using the sewer cleaning method comprising the steps of positioning sewer cleaning module components upstream of a sewage line section, lowering the components into the sewage line section, assembling the components into a sewer cleaning module, connecting the module to a power unit and a towing unit, and providing power to the module while simultaneously towing the module. The method may further comprise the steps of agitating and dredging the sewage. The method may further comprise the steps of generating a sewage slurry forwardly of the module, or rending and withdrawing the sewage slurry rearwardly of the module. The method may further comprise the steps of flailing and liquefying the sewage to generate the sewage slurry. The method may further comprise the steps of extracting the slurry, separating the slurry into sludge and liquid waste, returning the liquid waste to the line while retaining the sludge.

The preferred embodiment of the invention also comprises a sewage line cleaning system comprising, in combination, a power unit, a sewer cleaning module, an extraction and separation unit, and a towing unit. Preferably, the units are mobile and the power unit supplies hydraulic power to the sewer cleaning module. Alternatively, the power unit supplies electric or pneumatic power to the sewer cleaning module. The sewage cleaning module generates and propels a sewage slurry.

In an alternative embodiment of the sewer cleaning system, the extraction and separation unit is sited intermediate the power unit and the towing unit. In the preferred embodiment, the extraction and separation unit is sited at the power unit.

In all embodiments, the extraction and separation unit extracts the sewage slurry from the sewage line, separates the slurry into sludge and liquid waste, and returns the liquid waste to the sewage line.

In all embodiments, the towing unit tows the sewer cleaning module at a rate commensurate with sediment load, scale deposits, degree of compaction, and total volume of sewage.

The preferred embodiment of the invention comprises a method of cleaning a sewage line section comprising the steps of transporting and positioning a power unit, sewer cleaning module components, an sewage line section to be cleaned; lowering the sewer cleaning module components into the sewage line section; assembling the sewer cleaning module components into a sewer cleaning module; lowering extraction and return hose means from the extraction and separation unit; connecting the sewer cleaning module to the towing unit and the power unit; and providing power to the sewer cleaning module while simultaneously towing the module through the sewage line section at a rate commensurate with sediment load, amount of scale deposit, degree of compaction and total volume of sewage.

An alternative method of cleaning a sewage line includes the additional steps of siting the extraction and separation unit intermediate the power unit and the towing unit. Preferably, the extraction and separation unit is sited at the power unit.

An alternative method of cleaning a sewage line section includes the additional steps of generating and propelling a sewage slurry by agitating and liquefying the sewage forwardly of the module, extracting and separating the slurry into sludge and liquid waste, and returning the liquid waste to the line.

Alternatively, the steps of generating and propelling the sewage slurry include the steps of rending and withdrawing the sewage slurry rearwardly of the module.

The preferred embodiment of the method of cleaning a sewage line section further comprises the steps of disconnecting, disassembling, and raising the sewer cleaning module components, and transporting and repositioning the power unit, sewer cleaning module components, extraction and separation unit and towing unit over and above another sewage line section.

A primary object of the invention is the provision of a portable sewer cleaning module which may be assembled and disassembled in situ.

Another object of the invention is the provision of a sewer cleaning module adapted to fit varying pipeline diameters.

A further object of the invention is a method for generating a sewage slurry whereby deleterious pipeline scale deposits are removed by the cavitation and fluid abrasion action of such slurry.

Yet another object of the invention is the provision of a sewer cleaning system utilizing a sewer cleaning module, a power unit, an extraction and separation unit and a towing unit.

One advantage of the present invention is the provision of a sewer cleaning module system and methods whereby pipeline cleaning is effected without excavation or interruption of sewage flow and street traffic.

Another advantage of the invention is the provision of an economical sewer cleaning system that does not receive scraping or scaling of brittle pipeline walls by mechanical implements.

Other objects, advantages and novel features, and further scope of applicability of the present invention will be set forth in part in the detailed description to follow, taken in conjunction with the accompanying drawing, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention.

DETAILED DESCRIPTION OF THE PREFERRED EMBODIMENTS OF THE INVENTION (BEST MODES FOR CARRYING OUT THE INVENTION)

The present invention relates to improved sewer cleaning modules, systems employing such modules, and methods for their use. The sewer cleaning modules, while designed primarily for sewage line cleaning purposes, are of general application. As such, they may be used in cleaning oil pipelines, water mains, and the like. The discussion herein pertaining to sewage and sewage lines is applicable to other wastes, slurries, conduit, channels (open and closed) and pipelines.

Figure 1:
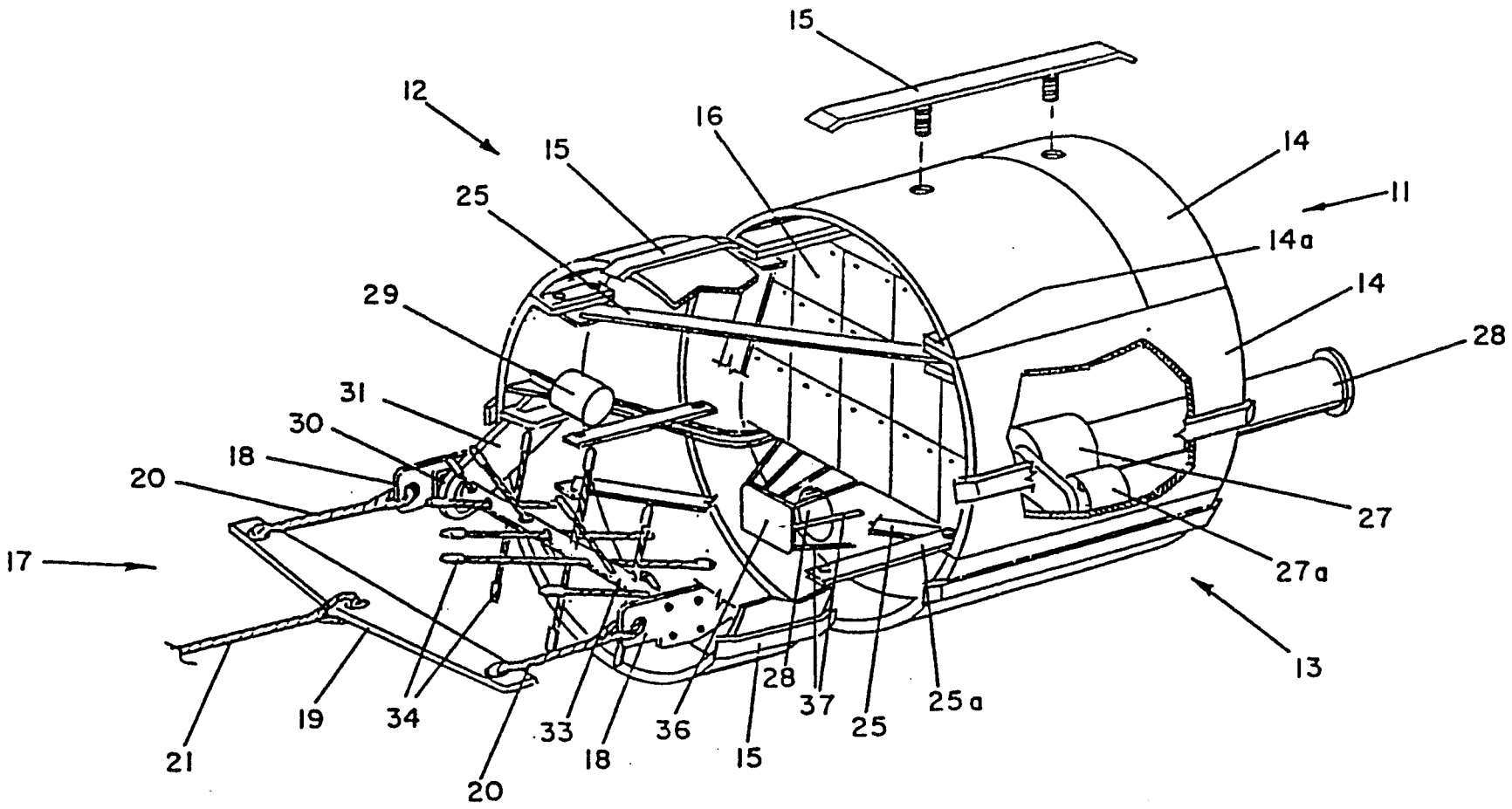
FIG. 1 is a perspective view of the preferred sewer cleaning module of the invention.
Figure 2:
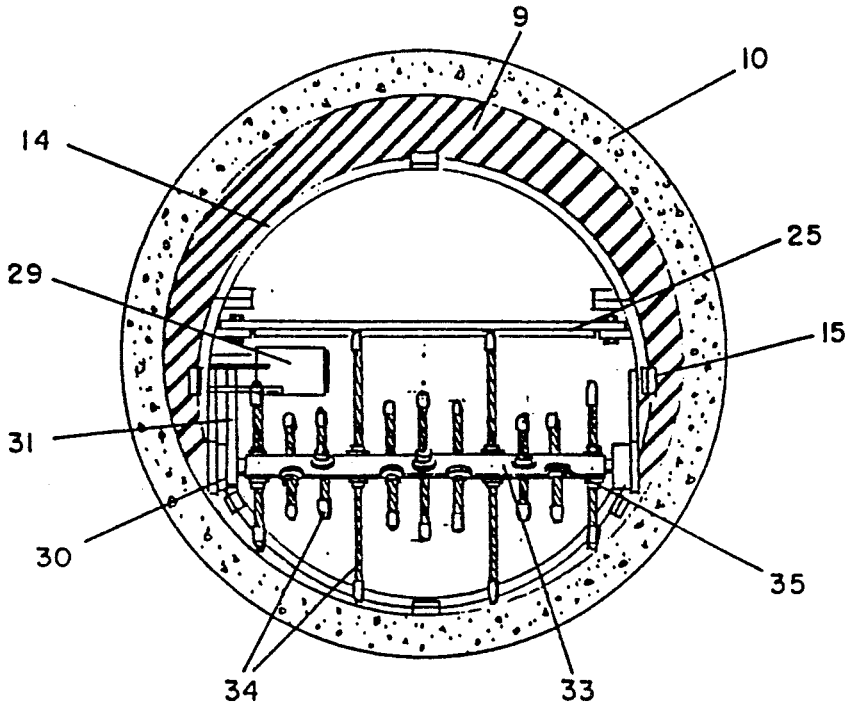
FIG. 2 is a front view of the embodiment of FIG. 1.
Figure 3:
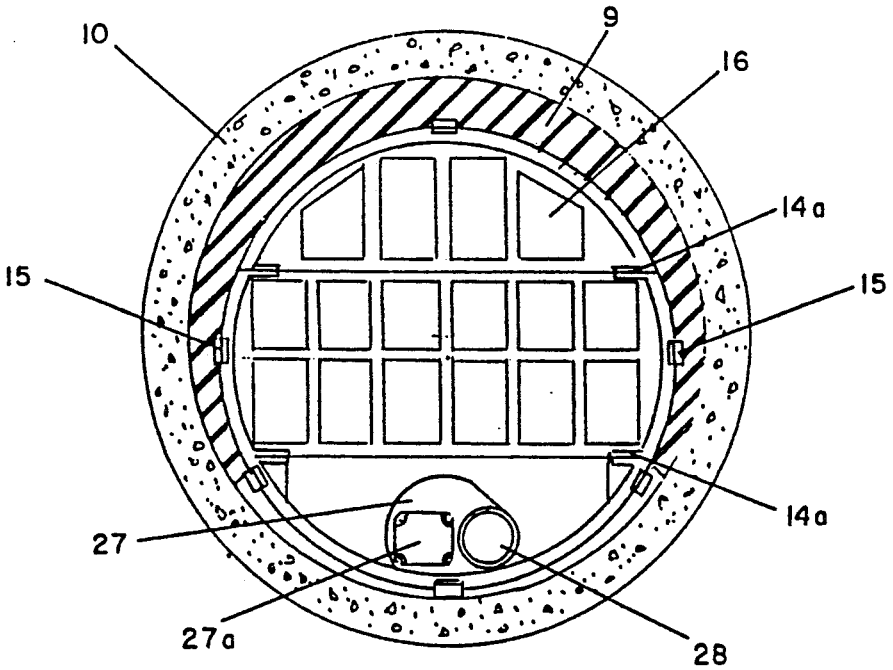
FIG. 3 is a rear view of the embodiment of FIG. 1.

Reference is made to FIGS. 1-3 of the drawings which show the preferred embodiment of the sewer cleaning module. As shown therein, sewer module 11 is depicted in an assembled state inserted in a sewer line 10 to be cleaned.

The preferred embodiment of sewer cleaning module 11 generally comprises a frame assembly, in turn comprising a forward unit 12 and a rear unit 13. Each unit comprises four arcuate segments 14; an upper segment, two center segments, and a lower segment. Arcuate segments 14 comprise flanges **14*a*, which are secured circumferentially by bolts or the like. Additionally, the segments have skids or runners 15 secured thereto by bolts or the like providing sliding support for module 11. A rubber shield 9 circumscribes the upper portion of rear unit 13. thereby providing a cushion against impact with sewer line 10**.

Arcuate segments 14 are normally assembled in situ in the sewer line. Radial dimensions and angular extent of segments 14 are governed by the diameter of the pipeline to be cleaned. For example, pipelines of 24", 36", and 48", respectively, would require arcuate segments 14 of differing radial dimensions. Angular arcuate extent, normally constant could also be varied. Longitudinal extent of units 12 and 13 may also vary; normally, rear unit 13 is of greater length.

Units 12 and 13 are hingedly connected by hinge assembly 25. Hinge assembly 25 provides sewer module 11 with the capability of negotiating corners and curves in the pipeline. Hinge assembly 25 comprises flat steel bars or the like extending diagonally between units 12 and 13. Each end of the bars is pivotally connected to the internal flanges of segments 14, preferably by the segment securing bolts. Safety links **25*a* provide overall frame assembly integrity in the event hinge assembly 25** fails.

Sewer cleaning module 11 also comprises yoke 17 by which module 11 is drawn or towed through the pipeline. Yoke 17 comprises longitudinally extending tongues 18, welded or brazed to forward unit 12, mounting universal connecting members 20. Connecting members or cables 20 detachably engage crossbar 19 by hooking through apertures in crossbar 19. Towing cable 21 is fixedly attached to crossbar 19. The detachable connection of connecting members or cables 20 and crossbar 19 provides a quick connect-disconnect capability for sewer cleaning module 11.

In the preferred embodiment, tongues 18 rotatably mount output shaft 33 in bearings thereon. Output shaft 33, in addition to sprocket 30, mounts a plurality of wire rope or cable flails 34 thereon. Flails 34 are of variable length and diameter; both dimensions depend upon sewer pipe diameter. Normally the diameter of flails 34 is 1"; the length of flails 34 increases toward the center of sewer pipe 10. Flails 34 are disposed in lines at staggered intervals (e.g., 60°) about shaft 33.

Flails 34 are secured to shaft 33 by sleeves 35. Sleeves 35 are inserted in apertures in shaft 33, then welded or brazed to shaft 33. Flails 34 are inserted in sleeves 35 and secured thereto by screws or bolts. Mounting flails 34 in this manner provides rapid replacement of flails 34.

Preferably, output shaft 33 is chain driven Motor 29, mounted in forward unit 12, is operatively connected to sprocket 30 by chain 31. Preferably hydraulic, motor 29 may also comprise an electric or pneumatic motor. Rotation of shaft 33 is preferably clockwise, as viewed in FIG. 1; when activated, flails 34 churn, agitate, and otherwise disintegrate compacted sewage in sewer line 10 to particulate form. Particulate and liquid waste can then be dredged from sewer line (e.g., by suction).

Rear unit 13 comprises pump 27 hydraulically (or electrically or pneumatically) driven by motor **27*a* and connected to the power unit described above and to motor 29. Pump 27 is a centrifugal pump with "winglet" rotor providing suction for solid and liquid wastes through suction hose 28 (preferably 6" in diameter). Suction hose 28 also obtains suction from a booster pump aboard mobile power unit 500 (see FIGS. 13 and 14**).

In the preferred embodiment, rear unit 13 comprises flap valves 16 mounted about the forward end of rear unit 13. The valves are of sufficient number and strength to assure unidirectional flow (check valve operation). As shown in FIG. 1, flap valves 16 are fastened only at the forward end of rear unit 13; this readily permits downstream flow of sewage effluent by flexing or bending of the valves. Flow in the opposite direction is effectively blocked. Flap valves 16 are preferably constituted of tough, flexible, durable material, such as a reinforced plastic, hard rubber, or the like.

Rear unit 13 further comprises baffle 36 positioned over the entrance to discharge pipe 28. Baffle 36 is supported by baffle rods 37 anchored to rear unit 13. Baffle 36 shields and deflects blocky solid waste from entering discharge pipe 28 while freely permitting entry of liquid and suspended particulate waste therein.

Figure 4:
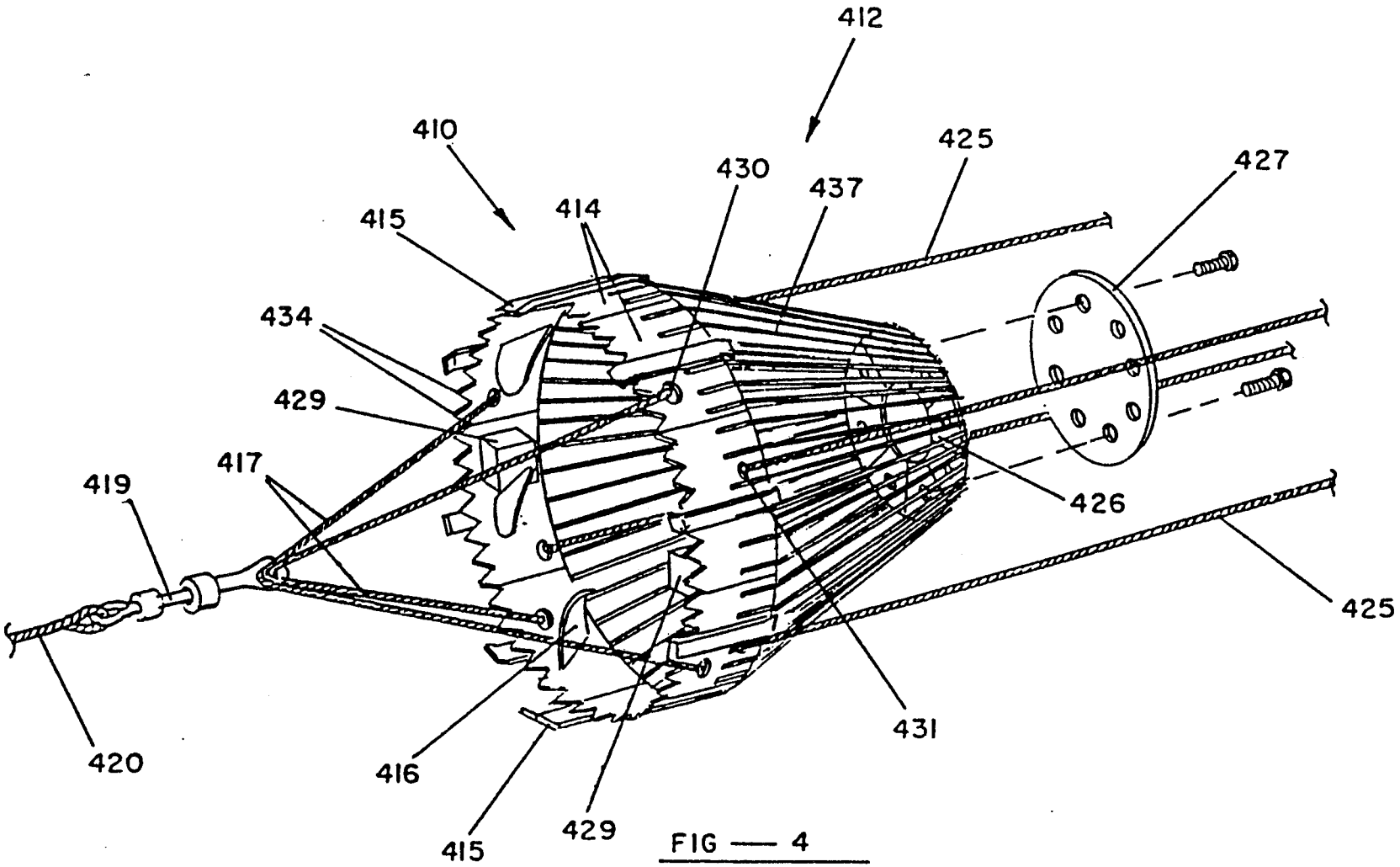
FIG. 4 is an alternate embodiment of a front unit of the embodiment of FIG. 1.
Figure 5:
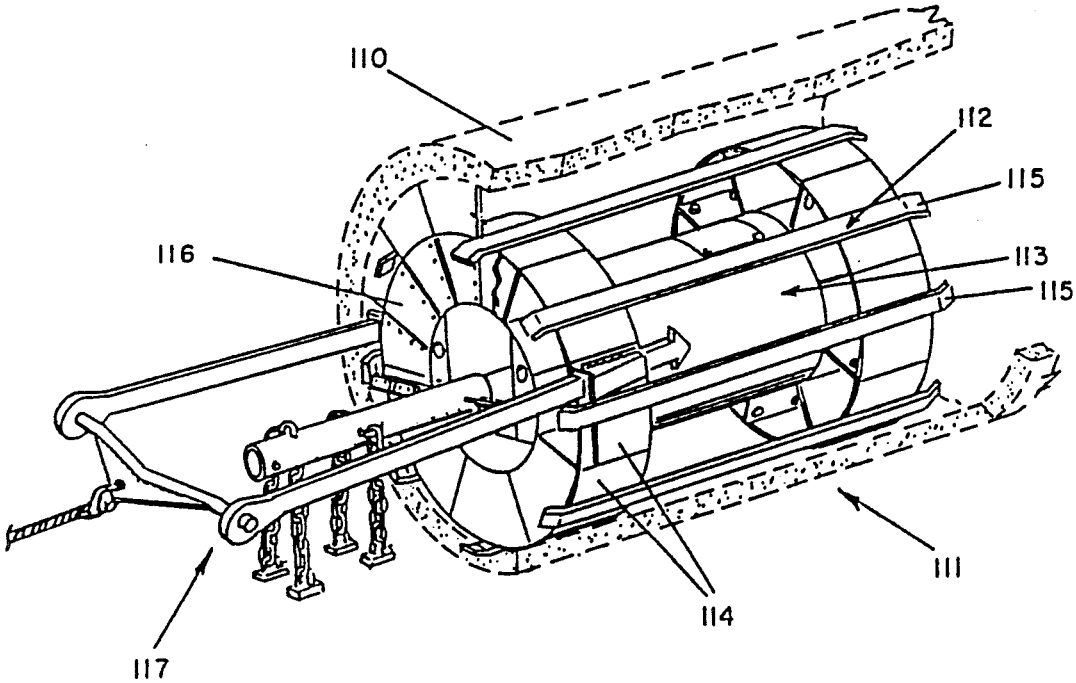
FIG. 5 is a perspective view of an alternative embodiment of the sewer cleaning module.
Figure 6:
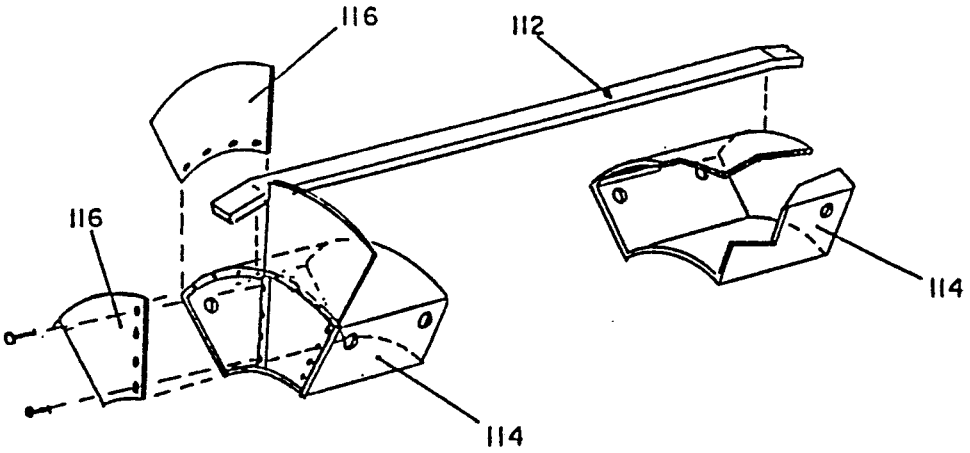
FIG. 6 is an expanded view of the support means and ribs of the alternative embodiment of the sewer cleaning module.
Figure 7:
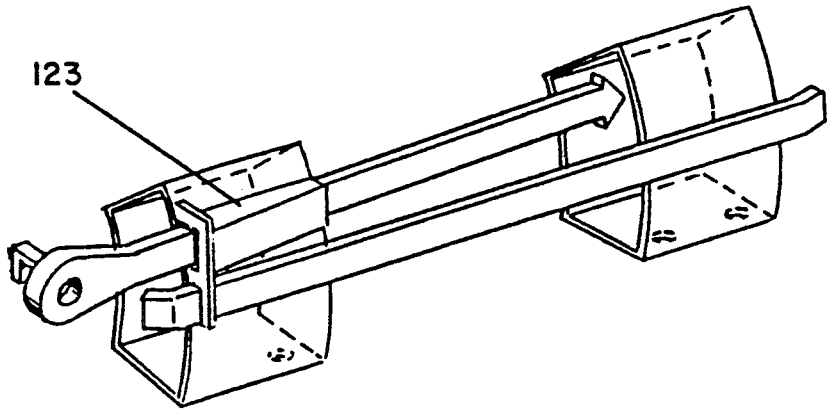
FIG. 7 is a perspective view of the yoke of the alternative embodiment of the sewer cleaning module.
Figure 8:
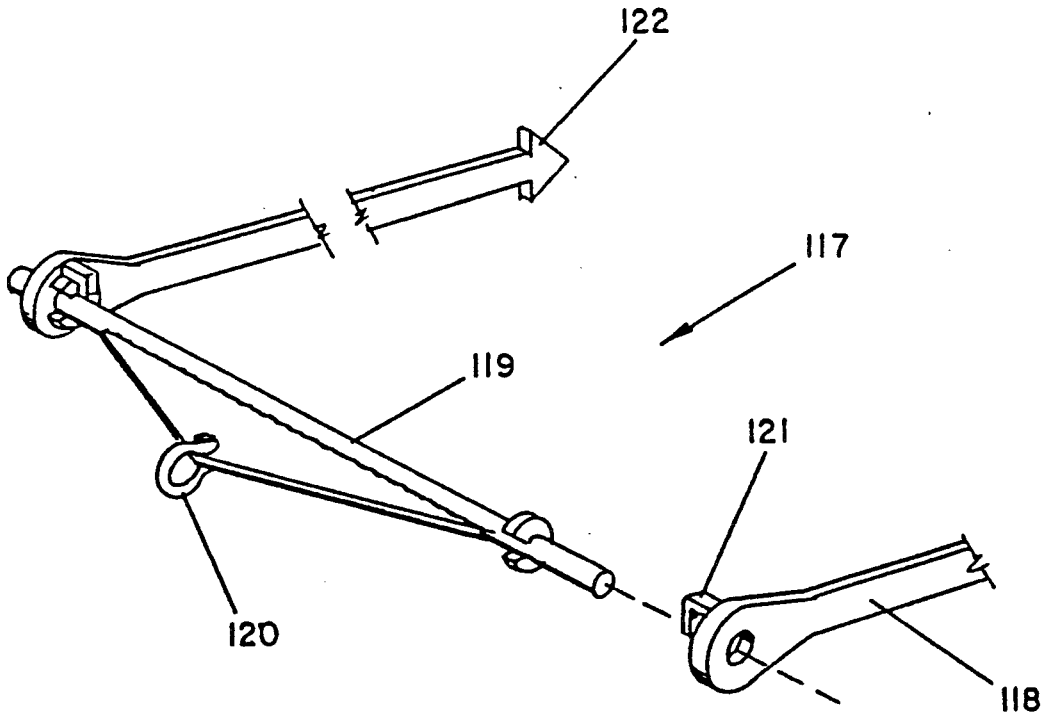
FIG. 8 is an exploded view of the yoke of the alternative embodiment of the sewer cleaning module.

FIG. 4 depicts an alternative embodiment of forward unit 412 of sewer cleaning module 11. Forward unit 412 comprises annulus 410, in turn comprised by a plurality of toothed arcuate segments 414. Preferably eight in number, toothed arcuate segments 414 comprise a plurality of forwardly projecting teeth 434. Each segment 414 further comprises an axially extending skid or runner 415 providing reduced sliding friction between unit 412 and the walls of sewer line 10. Skids 415 are secured to the outer periphery of each arcuate segment 414 by welding, brazing, bolting, or the like. In like manner, fins 416 are secured to the inner surfaces of each arcuate segment 414 imparting a rotational motion component to forward unit 412, as well as stability.

Alternate arcuate segments 414 also comprise fore-and-aft staggered apertures 430, 431. Apertures 430 secure towing harness 417, while apertures 431 provide attachment for cables 425 secured to the rear unit 13 of sewer cleaning module 11.

Forward unit 412 further comprises a plurality of bars 437 (preferably steel) attached to annulus 410. Steel bars 437 extend rearwardly and downwardly and are attached to rear plate 426. Cover plate 427 is bolted or otherwise secured to rear plate 426. The resulting open cage structure permits free passage of sewage effluent.

Annulus 410 additionally comprises vibrators 429 diametrically and horizontally positioned within and mounted to annulus 410. Vibrators 429 may also be pneumatically or electrically powered; when energized, vibrators 429 agitate forward unit 412, thereby disintegrating, dispersing, and pulverizing compacted sewage.

Harness 417 is secured to tow cable 420 by swivel joint 419. Swivel joint 419 permits rotational motion of forward unit 412, thereby aiding in disintegration of solid waste.

Reference is now made to FIGS. 5–12 of the drawings which show an alternative embodiment of the sewer cleaning module. As seen therein, sewer cleaning module 111 is also depicted in an assembled state inserted in a pipeline 110 to be cleaned. With specific reference to FIGS. 5 and 9, module 111 generally comprises frame assembly 112 and drive assembly 113 mounted coaxially within frame assembly 112.

In this embodiment, frame assembly 112 comprises a plurality of preformed segmental support members 114 interconnected by longitudinally extending ribs 115 by welding, brazing, or the like. In addition to providing longitudinal support, the bottom-most ribs 115 serve as skids or runners for the module. Segmental support members 114 are secured circumferentially by bolts or the like when assembling the sewer cleaning module, resulting in frame assembly 112 having a cylindrical configuration. Again, the radial dimension and angular extent of segmental support means 114 are governed by the diameter of the pipeline to be cleaned; for example, pipelines of 24", 36", and 48", respectively, would require segmental support members of differing radial dimensions and relative overall size. Angular extent, while normally constant, could also be varied. Frame assembly 112 could comprise eight units of segmental support members 114 joined by longitudinally extending members ribs 115; each such unit would comprise a pair of segmental support members 114 joined by a longitudinally extending rib 115. Assembly could occur after such units and other components had been lowered into a pipeline to be cleaned.

In this alternative embodiment, frame assembly 112 also comprises flap valves 116 mounted peripherally about one end of frame assembly 112. Flap valves 116 are fastened only at one side thereof to frame assembly 112; this readily permits downstream flow of sewage effluent by flexing or bending of the valves, but effectively blocks flow in the opposite direction.

Sewer cleaning module 111 also comprises yoke means 117 by which module 111 is drawn or towed through the pipeline. Yoke 117 further comprises slidable longitudinally extending tongue members 118, which detachably engage crossbar 119. Crossbar 119 includes towing cable attachment means 120, as well as locking mechanism 121 thereon. Tongues 118 are both slidably and pivotally mounted in lateral bearings 123, thereby facilitating engagement or crossbar 119 when assembling the module. Longitudinally extending tongues 118 are prevented from sliding through lateral bearings 123 by lugs 122.

Drive assembly 113 is coaxially mounted in frame assembly 112. With specific reference to FIG. 9, drive assembly 113 is preferably secured by slots 124 in slotted housing 125, engaging corresponding projections in frame assembly 112. Slotted housing 125 also has an access port 126 and vents (not shown) at the other end thereof.

Drive assembly 113 includes pump 127. Pump 127 directs liquid sewage through hoses at high velocity, exiting through nozzles 128. Preferably four in number, nozzles 128 aid in generating and liquefying a sewage slurry.

Figure 11:
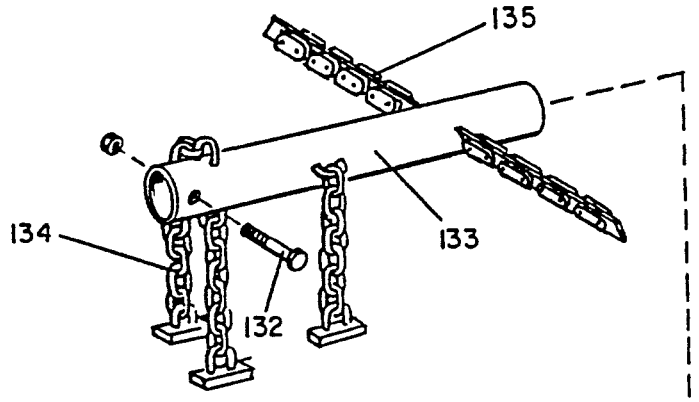
FIG. 11 is a perspective view of the output shaft of the alternative embodiment of the sewer cleaning module.
Figure 10:
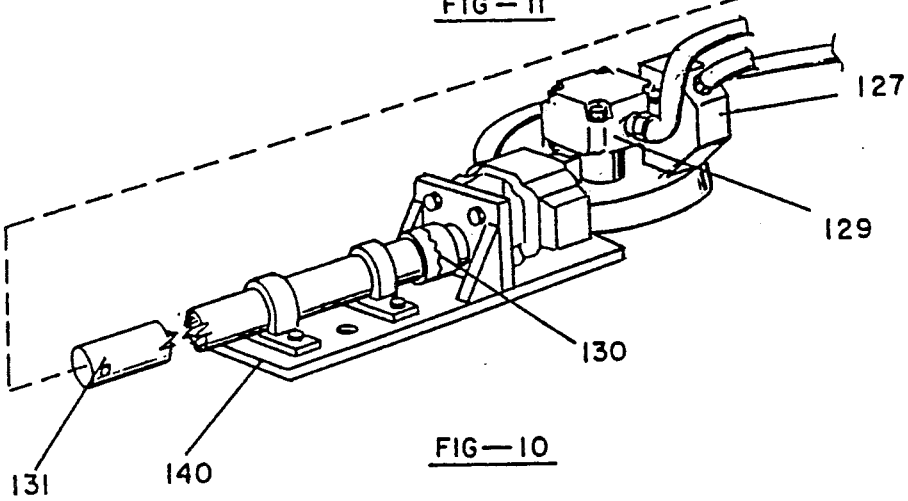
FIG. 10 is a perspective view of the drive of the alternative embodiment of the sewer cleaning module.
Figure 9:
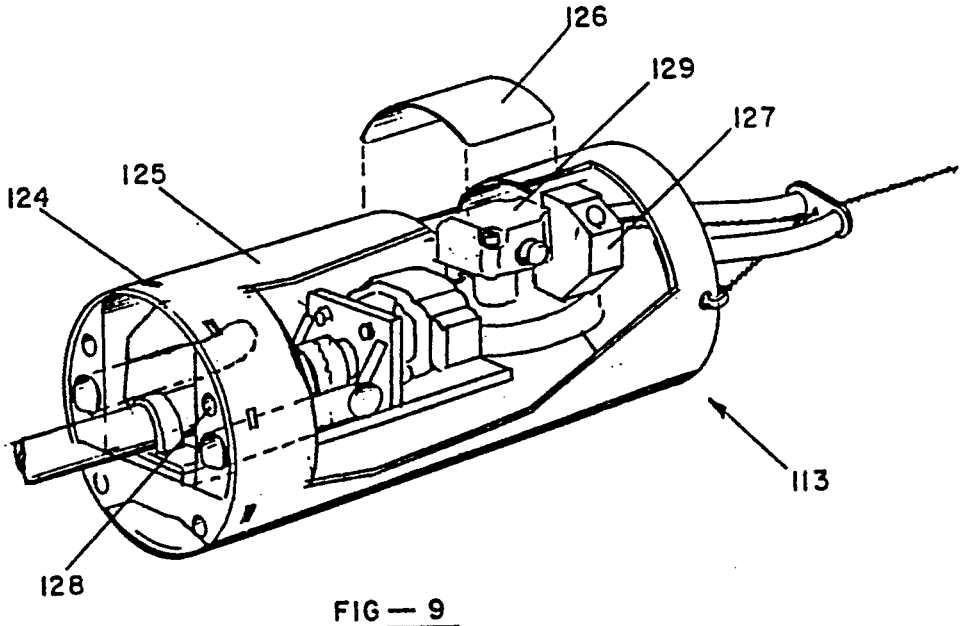
FIG. 9 is a cutaway view of the drive assembly of the alternative embodiment of the invention.

With specific reference to FIGS. 10 and 11, drive assembly 113 also includes motor 129, mounted therein by motor mount 140. Preferably hydraulic, motor 129 may also be an electric or pneumatic motor (not shown). Motor 129 is operatively connected to shaft 131 by gears 130. Shaft 131 is in turn connected to concentrically mounted output shaft 133 by shear pin 132.

Output shaft 133 includes flails 134 and impeller 135 mounted thereon. Flails 134, preferably lengths of chain with rectangular steel blocks secured thereto, are each preferably of a length less than the radius of pipeline 110 to avoid possible contact and damage to the pipeline. Impeller 135 is hingedly connected to output shaft 133, folding backwardly upon encountering an obstruction. In the alternative embodiment, sewer cleaning module 111 generates and propels a sewage slurry forwardly of such module. Flails 134, nozzles 128, and impellers 135 agitate, liquefy, and propel the slurry downstream of module 111. The generation and propelling of such slurry not only drives the sediment and sewage load forward, but also scours and removes scale deposits from the pipeline walls by cavitation and abrasive action alone. Flails 134 preferably do not contact the pipeline walls.

In a further alternative embodiment, a plurality of cutter means (not shown) are mounted on frame assembly 12 proximate flap valves 16. Cutter blades are mounted on output shaft 133 in lieu of impeller 135. When activated, these cutter blades, together with the stationary cutter blades on frame assembly 112, and nozzles 128 are operative to generate a sewage slurry by "chopping" or rending the sewage. The slurry thus generated is propelled rearwardly of sewer cleaning module 111 by suction from the mobile power unit 500 (see FIGS. 13 and 14).

Figure 12:
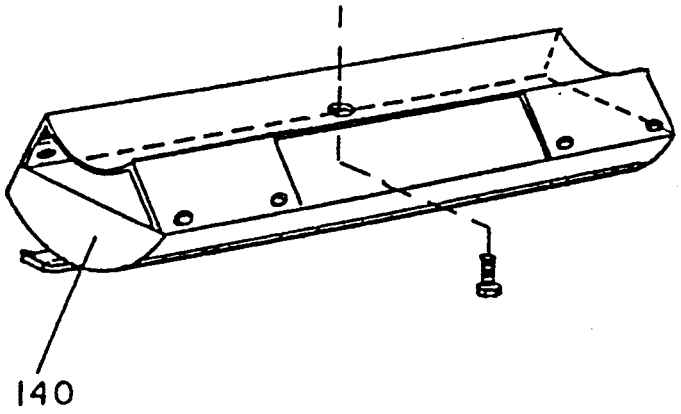
FIG. 12 is an isolated view of ballast means in the bottommost portion of the frame assembly of the alternative embodiment of the sewer cleaning module.

With reference to FIG. 12, ballasting 140 is provided in the bottom-most portion of the frame assembly to assure eccentric positioning of the shaft means relative to the pipeline. Lead, lead alloys, or other suitable metal could be used.

As can be appreciated by those skilled in the art, the frame configuration and other components can be modified to accommodate varying shapes of pipes, conduit, channels, and the like. The invention is not limited to the cylindrical embodiments shown therein.

Figure 13:
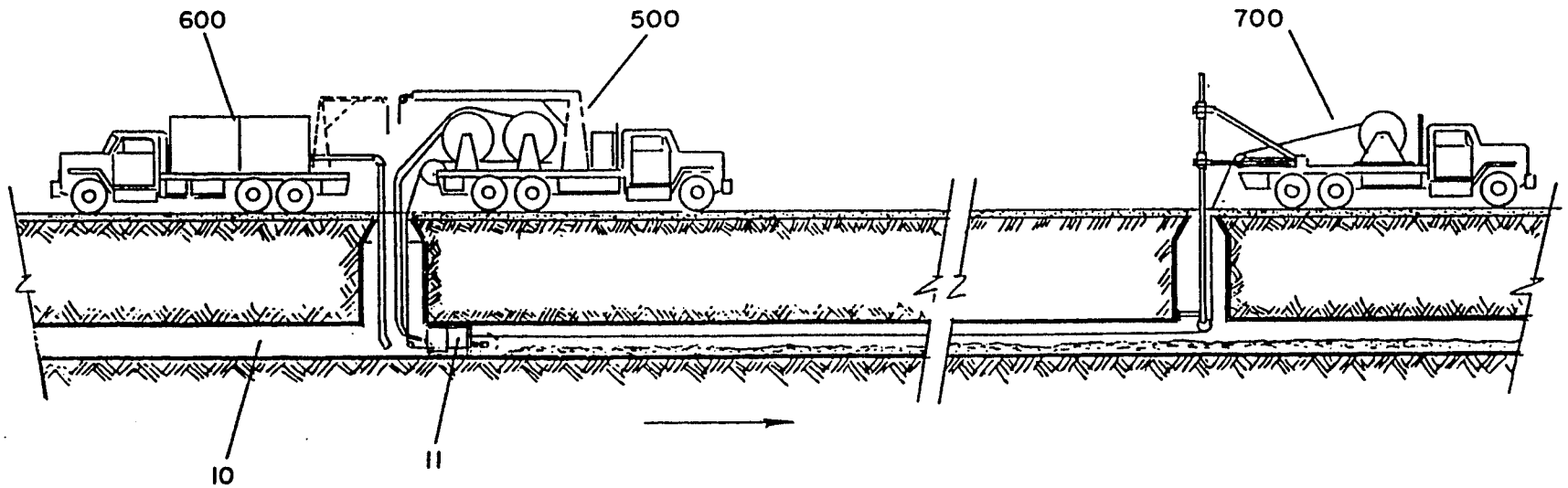
FIG. 13 is a side cross-section of the preferred sewer cleaning system of the invention.

With specific reference to FIG. 13, a preferred embodiment of a system for cleaning a sewage line section comprises, in combination, mobile power unit 500, sewer cleaning module 11, mobile extraction and separation unit 600, and mobile towing unit 700. In the preferred embodiment of the system, all units are mobile and are positioned over and along a sewage line section 10 to be cleaned. Although the discussion of this sewer system pertains to the preferred sewer cleaning module 11, it is also applicable to the alternative sewer cleaning modules 111, and other sewer cleaning devices.

In the preferred embodiment of the system, extraction and separation unit 600 is sited upstream proximate mobile power unit 500 which provides suction rearwardly of the sewer cleaning module. Mobile towing unit 700 is sited downstream.

Figure 14:
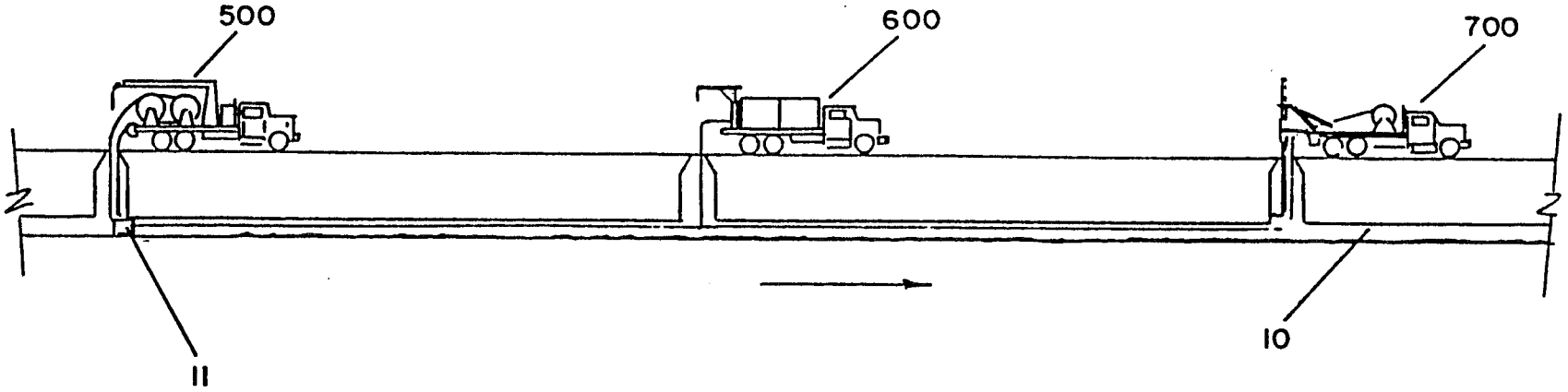
FIG. 14 is a side cross-section of an alternative embodiment of the sewer cleaning system of the invention.

In an alternative embodiment of the system, shown in FIG. 14, power unit 500 and sewer cleaning module components are sited furthest upstream, towing unit 700 is sited furthest downstream, and extraction and separation unit 600 is sited intermediate the power unit 500 and towing unit 700.

Sewer cleaning module 11 components are lowered into the sewage line. Sewer cleaning module 11 is then assembled and connected to towing unit 700 and power unit 500. Power is provided to sewer cleaning module 11 simultaneously while towing the module through the sewage line section 10 at a rate commensurate with sediment load, amount of scale deposit, degree of compaction, and total volume of sewage.

Mobile power unit 500 comprises a platform truck (e.g., 28') mounting a plurality of components to system operation. Mounted rearmost on the platform is a power winch wound with cable (e.g., ½" cable). This cable is attached to the rear of the sewer cleaning module as a safety tether.

Mobile power unit 500 further comprises two hydraulic hose reels (e.g., 4½') providing hydraulic supply and return lines to sewer cleaning module 11.

Mobile power unit 500 also comprises a reel (e.g., 10') mounting discharge hose (e.g., 6" diameter). The booster pump aboard mobile power unit 500, coupled with the discharge hose, assists in transporting solid and liquid waste from sewer cleaning module, 11 to mobile extractor and separator unit 600.

Mobile power unit 500 further comprises a self-contained hydraulic power unit comprising an internal combustion (IC) engine, preferably diesel, together with requisite fuel tanks.

In the preferred embodiment, power unit 500 supplies open- or closed-ended hydraulic power to sewer cleaning module 11; alternatively, electric or pneumatic power could also be supplied. Preferably also, power unit 500 comprises appropriate control mechanisms for determining the speed and torque of motor 29 in sewer cleaning module 11.

Figure 15:
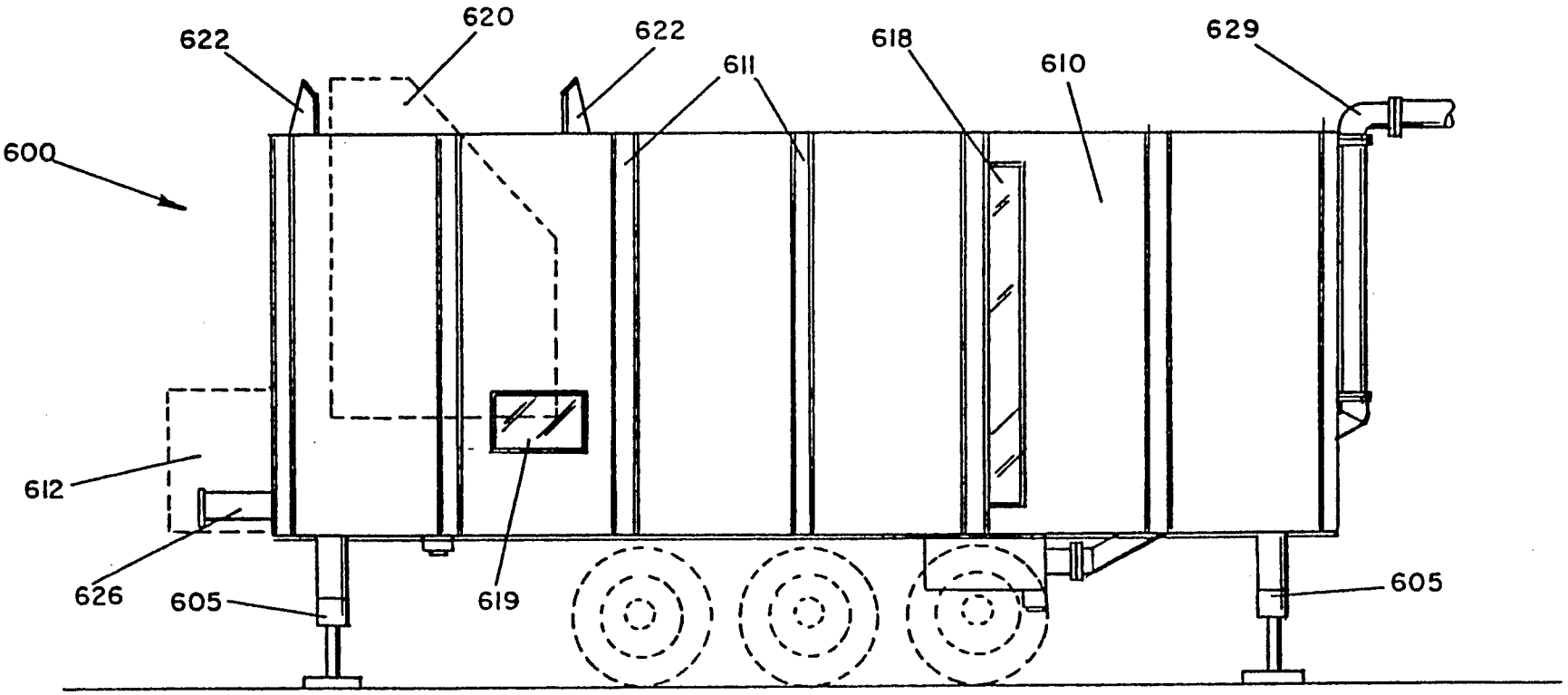
FIG. 15 is a side view of the mobile extractor and separator unit.
Figure 16:
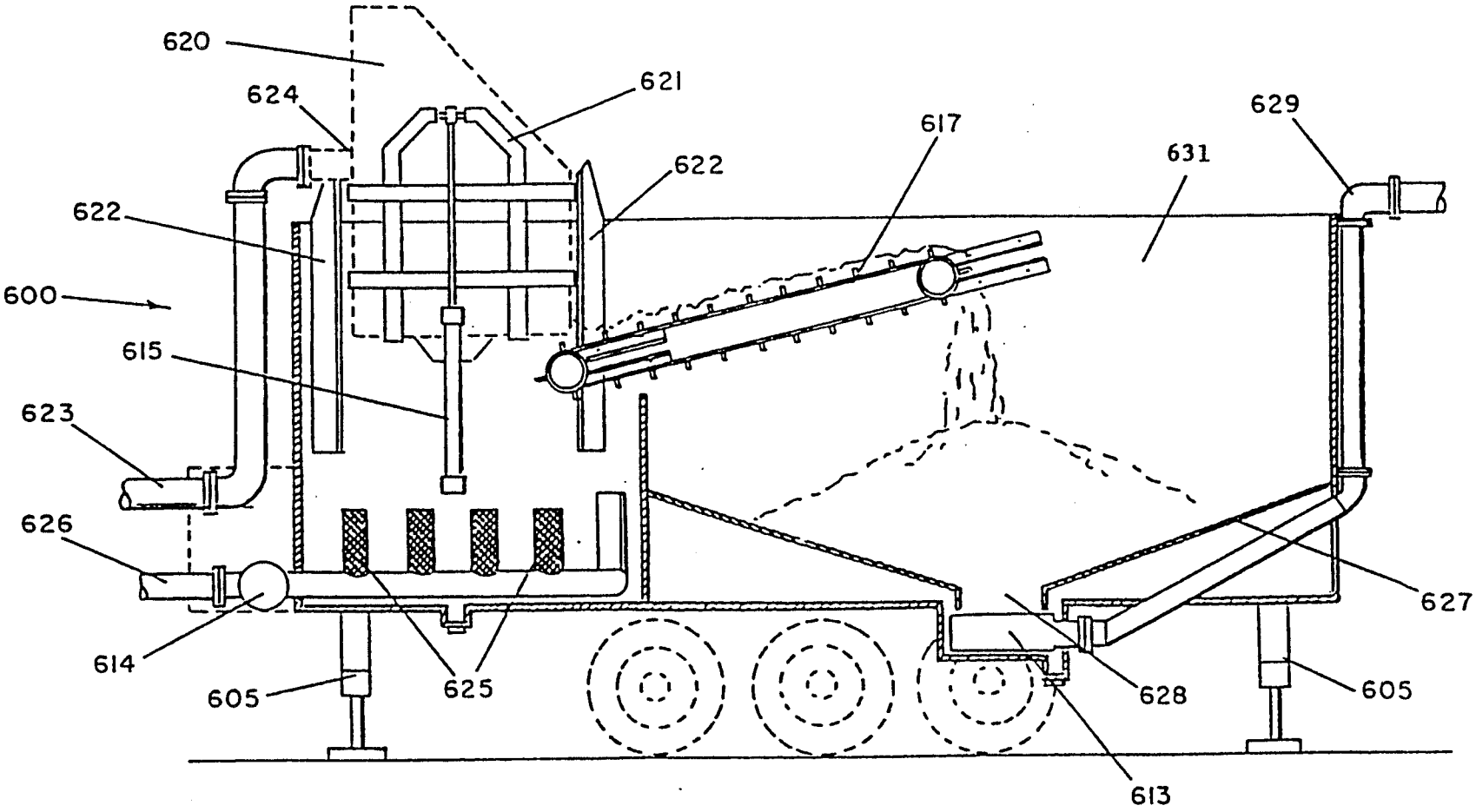
FIG. 16 is a side cross-section of the mobile extractor and separator unit.

FIGS. 15 and 16 depict mobile extractor and separator unit 600 in the operating position. Mobile extractor and separator unit 600 is provided with hydraulic jacks 605 to provide the additional support necessary to support up to, e.g., 100,000 pounds of raw sewage. Lateral support for walls 610 of unit 600 is provided by reinforcing channels 611. A self-contained power unit 612 comprising an internal combustion (IC) engine (preferably diesel) is provided to power the required hydraulic system, including pumps 613, 614, hydraulic actuators 615, and conveyor 617. Viewing windows 618 and 619 are provided in walls 610 to observe operation and detect any malfunctioning of unit 600.

Operation of mobile extractor and separator unit 600 is best illustrated in FIG. 16. Unit 600 comprises separator unit 620, which may comprise a Model W-600 ADF Wedge Water Sieve manufactured by Gravity Flow Systems, Inc.; other comparable separator systems may also be used. Separator unit 620 is removably nested within cradle 621. Cradle 621 comprises an open framework structure connected to hydraulic actuators 615. Hydraulic actuators provide an elevational capability for cradle 621 and separator unit 620; cradle 621 and separator unit 620 are normally lowered when travelling (in compliance with traffic regulations) and raised when in operation. Cradle guides 622 journal cradle 621 and assure rectilinear vertical motion of cradle 621.

In operation, elevated separator unit 620 receives liquid and solid waste through intake pipe 623 and waste intake 624. The liquid and solid waste is pumped from sewer cleaning module 11 and additional pumping capacity is furnished by the booster pump aboard mobile power unit 500. Separator unit 620 separates liquid from solid waste; liquid waste falls through screened drains 625 into liquid discharge manifold 626. Conveyor 617 conveys solid waste to hopper 631. Liquid waste is returned to the sewer line by pump 614 and liquid discharge manifold 626.

Hopper 631 comprises angled sides 627 sloping downwardly to drainhole 628. Pump 613 pumps the solid waste through solid waste discharge pipe 629 to a tanker truck, dump truck hopper car, or the like, for removal.

Figure 17:
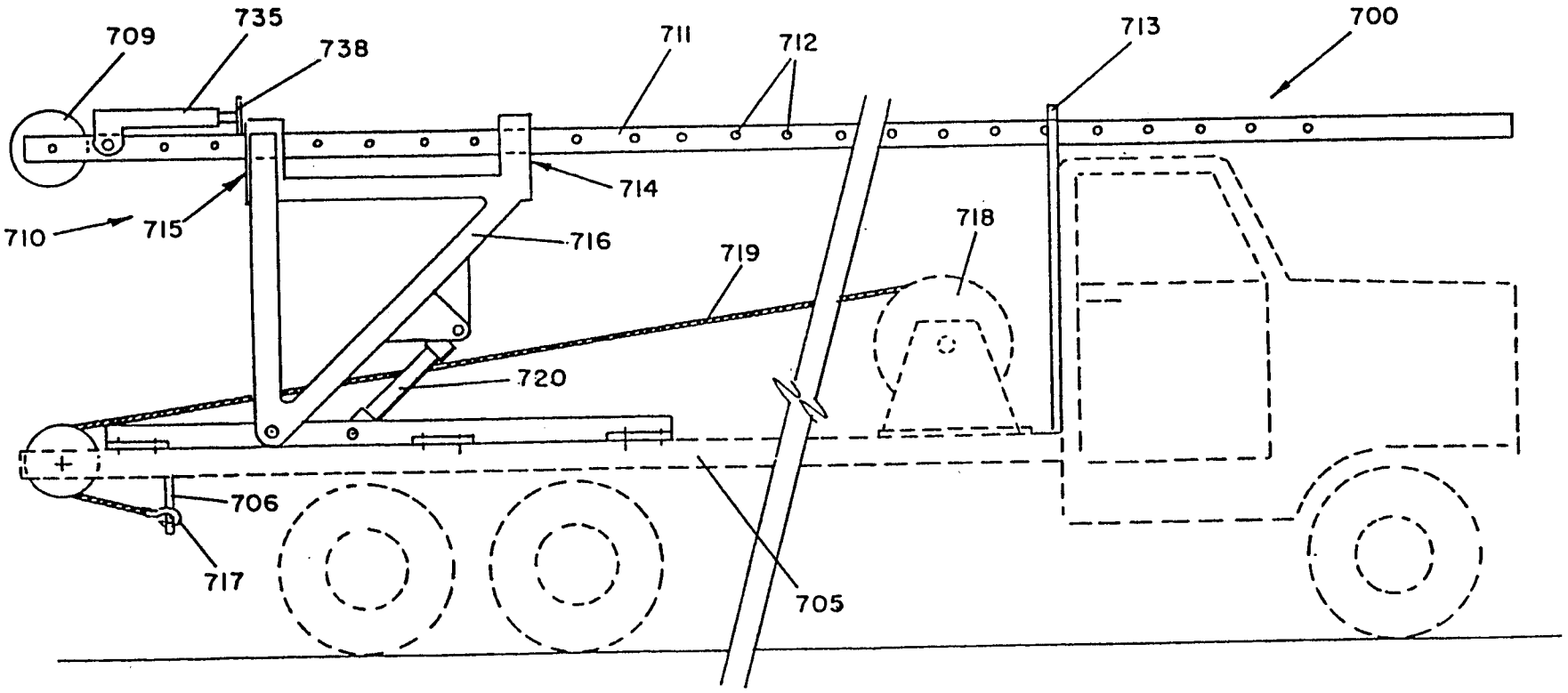
FIG. 17 is a side view of the mobile towing unit in travelling position.

FIG. 17 shows downhole boom 710 in the traveling position aboard mobile towing unit 700. Downhole boom 710 preferably comprises a suitable length of hollow square pipe 711 having a plurality of apertures 712 on opposed sides thereof. While travelling, the top portion of square pipe 711 is secured to and supported by cradle 713. The bottom portion of square pipe 711 is secured to and supported by upper and lower bearings 714, 715 mounted on bracket 716. Locking pins through apertures 712 secure and maintain square pipe 711 stationary while travelling.

Towing hook 717 is grappled to bar 706 projecting downwardly from truck bed 705. Appropriate tension is applied by winch 718 to assure cable 719 remains taut while travelling.

Figure 18:
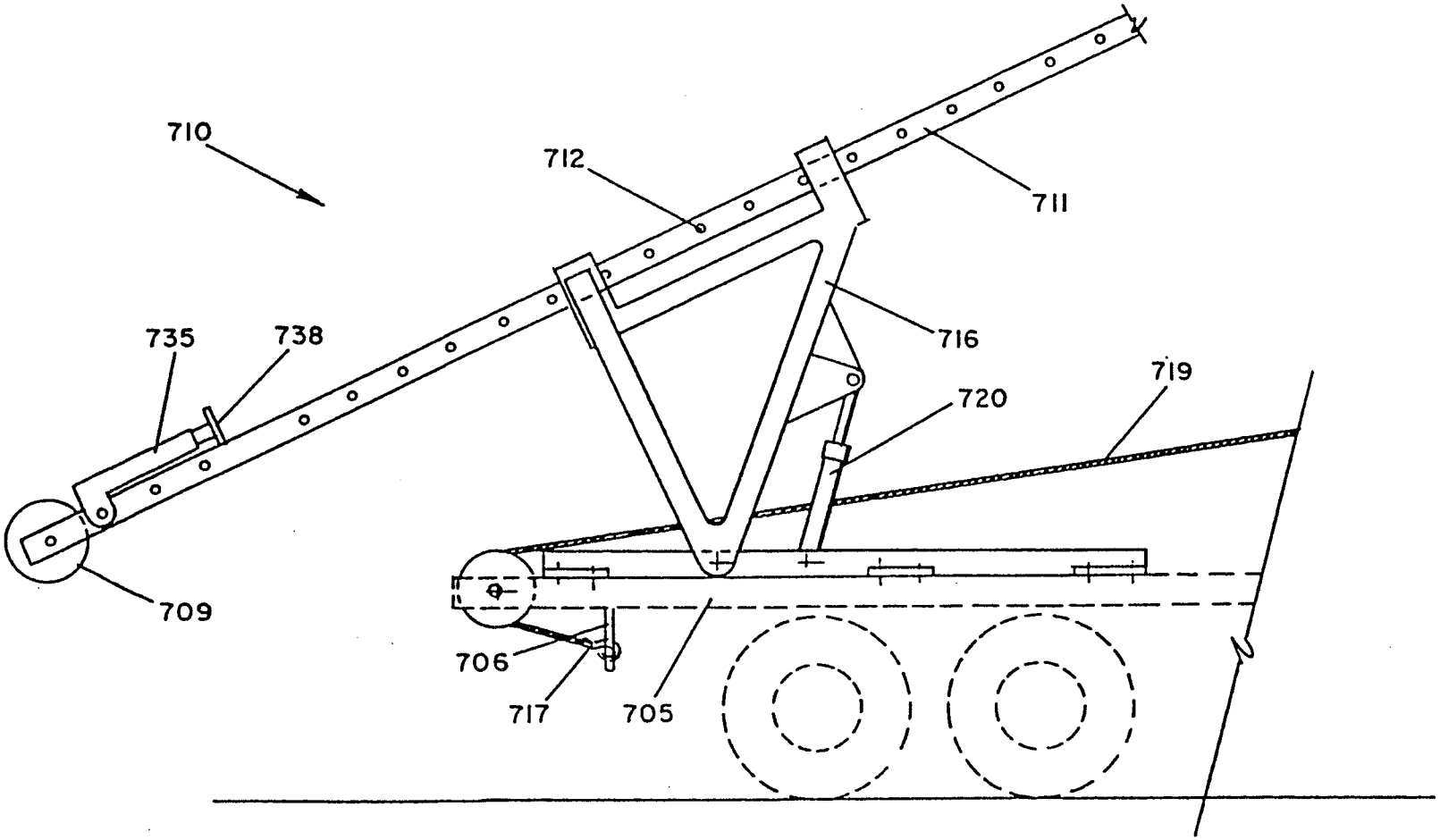
FIG. 18 is a side view of the mobile towing unit partially extended.
Figure 19:
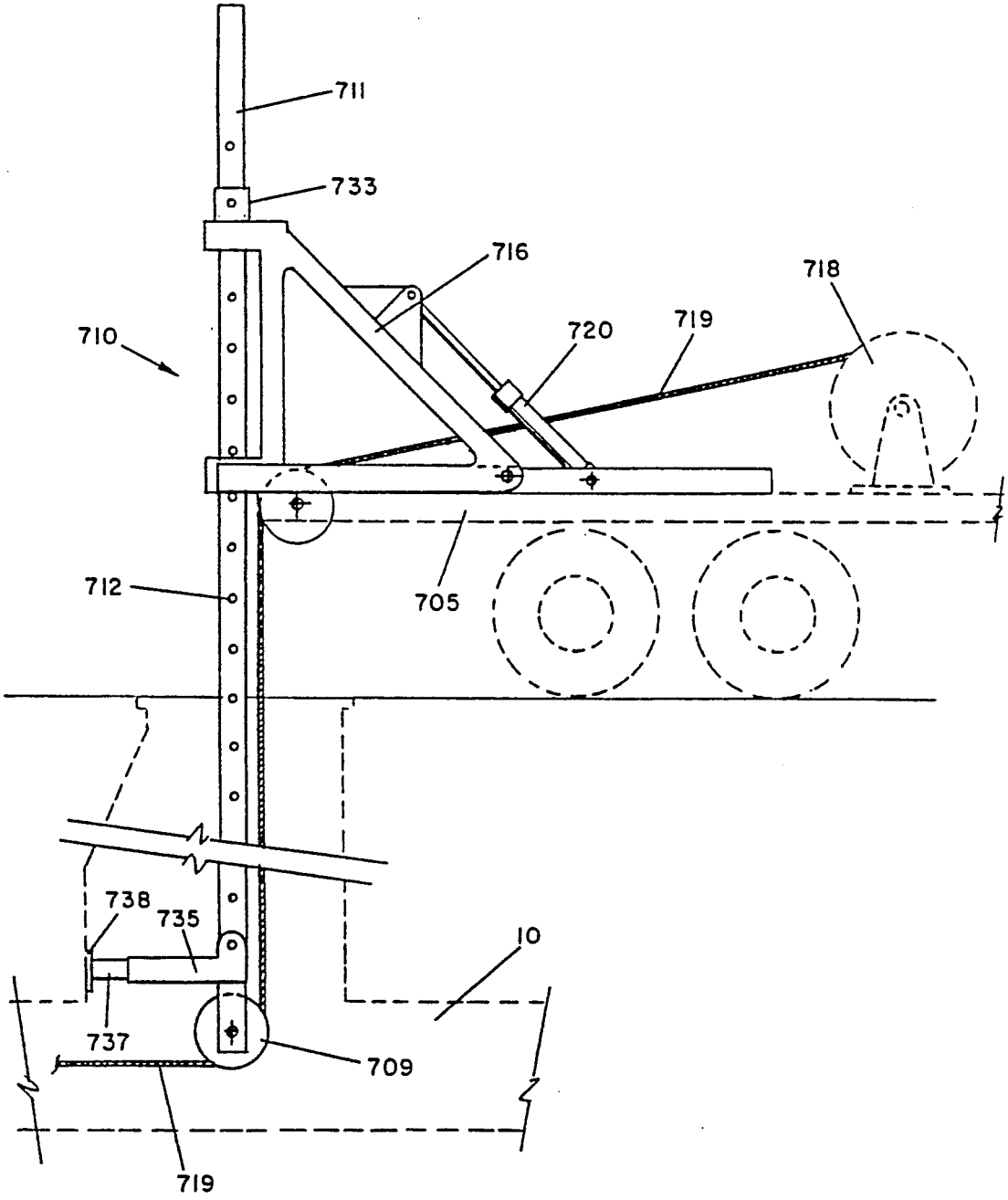
FIG. 19 is a side view of the mobile towing unit in the operating position.

Prior to extension and lowering downhole boom 710 into a selected manhole, the top portion of square pipe 711 is released from cradle 713. Hydraulic pressure is applied to hydraulic actuators 720, rotating bracket 716 and downhole boom 710 counterclockwise, as viewed in FIG. 18. Continued rotation, as depicted in FIG. 19, brings downhole boom 710 to the erect or operating position. Bracket 716 then abuts truck bed 705, providing support.

Figure 20:
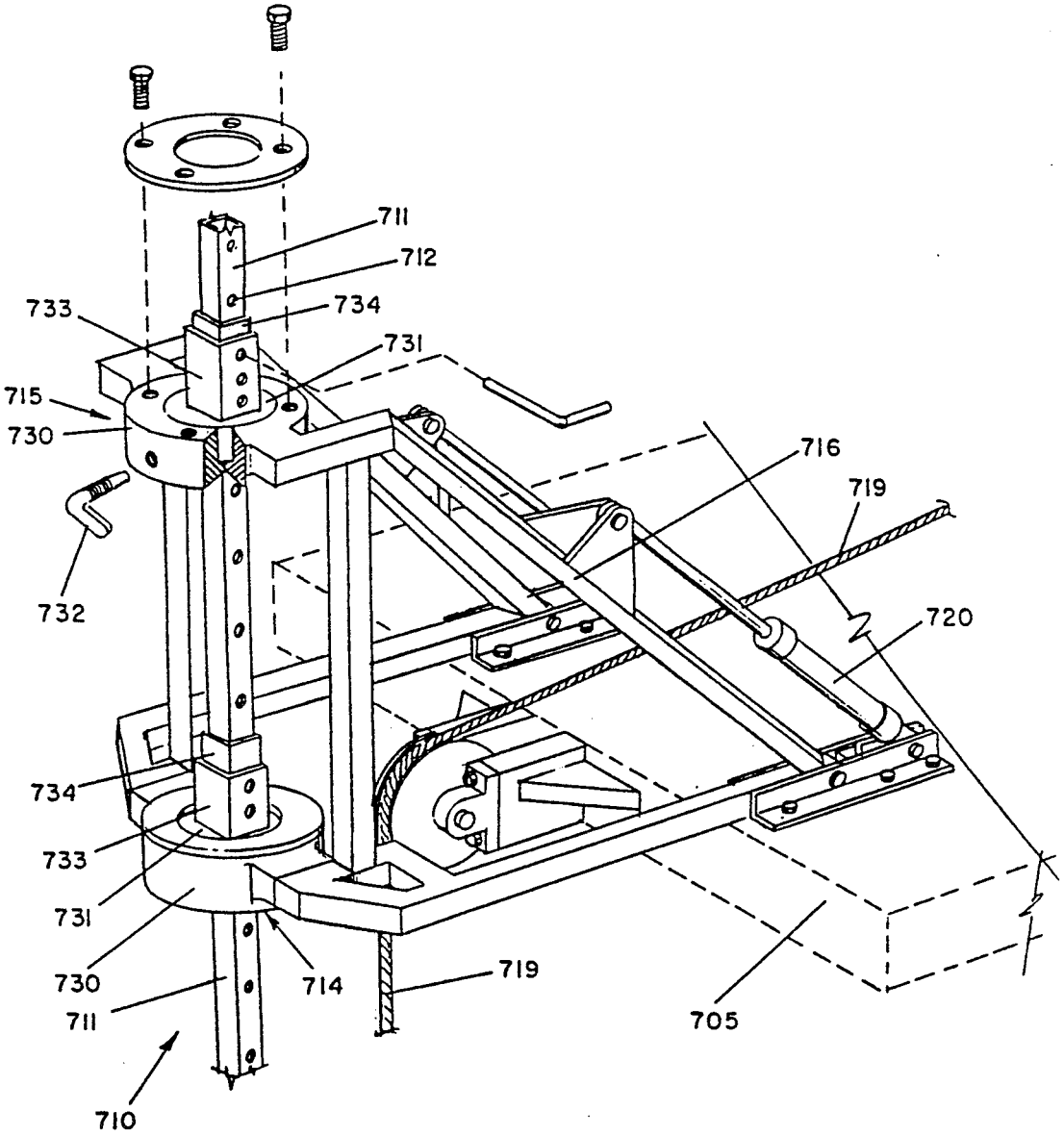
FIG. 20 is a cutaway perspective of the upper and lower bearings.

Upper and lower bearings, as shown in FIG. 20, provide rotational and lengthwise adjustment, as well as support, for square pipe 711. Each bearing comprises an annulus 730 fixed by welding, brazing, or the like, to bracket 716. Annulus 730 circumscribes relatively rotatable annular segment 731. Annulus 730 and rotatable annular segment 731 provide adjustment of the rotational attitude of square pipe 711. Threaded locking handle 732 secures annulus 730 and rotatable annular segment 731 against further rotation when the predetermined rotational attitude of square pipe 711 is attained by rotation of rotational annular segment.

Each rotatable annular segment 731 further surrounds and is fixedly secured to stationary square pipe bushing 733. Bushing 733 is apertured and freely permits longitudinal movement of square pipe 711 therethrough for lengthwise adjustment. Movement of square pipe 711 through bushing 733 is facilitated by sleeve 734, preferably made of plastic. Plastic sleeve 734 is fixed to square pipe 711 and extends a predetermined distance above and below each bearing 714, 715. Plastic sleeve 734 reduces sliding friction between pipe 711 and bushing 733, thereby eliminating the need for further lubrication. When the appropriate downhole length of square pipe 711 is reached, locking pins through the apertures of bushing 733 and square pipe 711 prevent further lengthwise displacement of square pipe 711.

Figure 21:
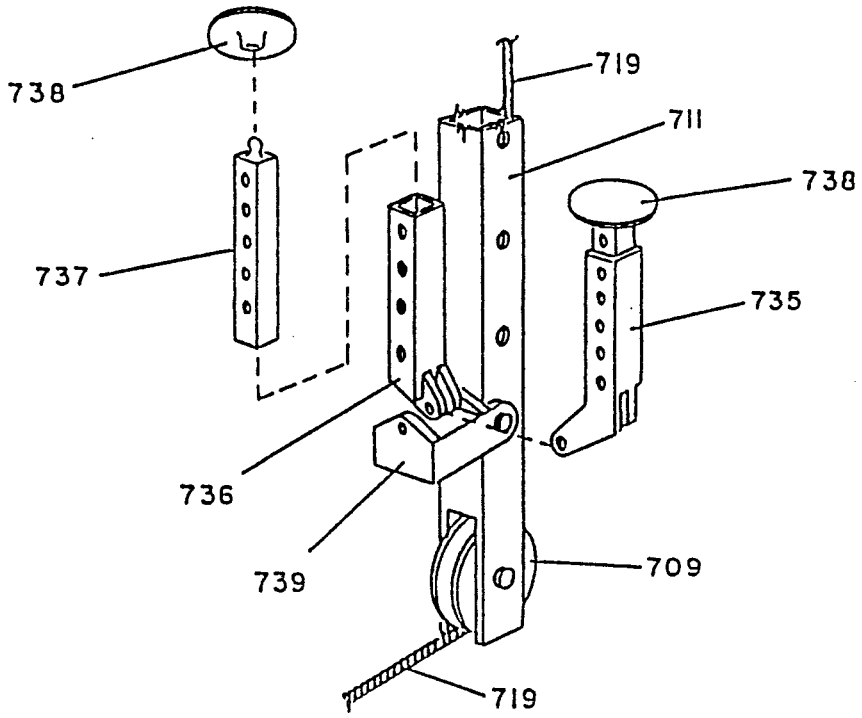
FIG. 21 is a perspective view of the braces in retracted position.
Figure 22:
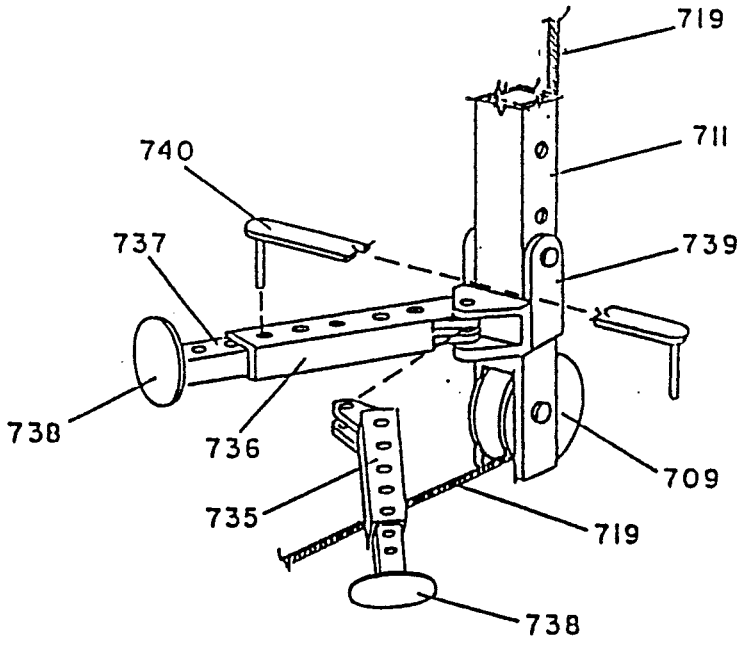
FIG. 22 is a perspective view of the braces in extended position.

References is now made to FIGS. 21 and 22 square pipe 711 remains centered in the manhole, braces 735 are provided at the downhole end of square pipe 711. Each brace comprises predetermined lengths of apertured square pipe 736 surrounding an identical inner apertured square pipe 737 of smaller dimension in telescoping relation. Inner brace-member 737 of braces 735 comprises a brace pad 738 at the end thereof. Brace pad 738 is secured to inner brace member 737 by a universal joint. As depicted in FIG. 21, braces are hingedly connected to brace carrier 739. Brace carrier 739 is, in turn, hingedly connected to square pipe 711. In the stored or retracted position, brace carrier 739 extends at right angles relative to square pipe 711; braces 735 thus extend upwardly parallel to square pipe 711, and are secured thereto by a strap, rope or the like.

As depicted in FIG. 22, to extend or engage braces 735, brace carrier 739 is rotated downwardly, thereby positioning braces 735 at right angles to square pipe 711. Inner brace members 737 are extended until brace pads 738 snugly abut the manhole walls, and are then secured to braces 735. Insertion of the locking pins of locking bars 740 into the appropriate apertures of brace members 735 prevents further movement of inner brace members 737.

After downhole boom 710 is firmly erected in the operating position, cable 719 is unreeled and threaded through pulley 709 down the manhole. A drogue device initially tows cable downstream from the sewer cleaning module to mobile towing unit 700. Ultimately cable 719 is connected thereto and towing of sewer cleaning module 11 commences. Upon termination of towing, downhole boom 710 is returned to the travelling position aboard mobile towing unit 700 by reversal of the erection sequence.

In the preferred embodiment of the system, towing unit 700 tows sewer cleaning module 11 at a rate commensurate with sediment load, amount of scale deposit, degree of compaction, and total volume of sewage. Normally, towing unit 700 tows seer cleaning module 11 at a constant speed based upon the average depth of silt within the sewer line 10 being cleaned.

Upon termination of cleaning the sewage line section, the sewer cleaning module is disconnected, disassembled, and raised, together with hoses and cables from the units.

Although the invention has been described with reference to these preferred embodiments, other embodiments can achieve the same results. Variations and modifications of the present invention will be obvious to those skilled in the art and it is intended to cover in the appended claims all such modifications and equivalents.

What is claimed is:

1. A method of using a pipe cleaning module comprising the steps of:

a positioning pipe cleaning module components upstream of a pipeline section to be cleaned;

b. lowering said components into the pipeline section;

c. assembling said components into a pipe cleaning module;

d. connecting said pipe cleaning module to a towing unit and a power unit; and e. providing power to said pipe cleaning module while simultaneously towing said pipe cleaning module through the pipeline section at a rate commensurate with sediment load, amount of scale deposit, degree of compaction, and total amount of sewage.

2. The invention of claim 1 further comprising the steps of generating the propelling a slurry relative to said pipe cleaning module.

3. The invention of claim 2 wherein the steps of generating and propelling a slurry further comprise the steps of failing and liquefying the slurry forwardly of said pipe cleaning module.

4. The invention of claim 2 wherein the steps of generating and propelling a slurry further comprise the steps of rending and withdrawing the slurry rearwardly of said pipe cleaning module.

5. The invention of claim 2 further comprising the steps of extracting the slurry and separating the slurry into sludge and liquid.

6. The invention of claim 5 further comprising the step of returning the liquid to the pipeline section.

7. The invention of claim 1 wherein the pipeline is a sewer pipe.

8. A method of cleaning an underground sewage line section comprising the steps of:

a) transporting and positioning a power unit, sewer cleaning module components, an extraction and separator unit, and a towing unit over and along a sewage line section;

b) lowering the sewer cleaning module components into the sewage line section;

c) assembling the sewer cleaning module components into a sewer cleaning module;

d) lowering extraction and return hose means from the extraction and separation unit into the sewage line section;

e) connecting the sewer cleaning module to the towing unit and the power unit; and f) providing power to the sewer cleaning module while simultaneously towing the module through the sewage line section at a rate commensurate with sediment load, amount of scale deposit, degree of compaction, and total amount of sewage.

9. The invention of claim 8 wherein the positioning comprises siting the power unit upstream of the extraction and separation unit and the towing unit.

10. The invention of claim 8 wherein the positioning comprises siting the extraction and separation unit at the power unit.

11. The invention of claim 8 wherein the positioning comprises siting the extraction and separation unit intermediate the power unit and the towing unit.

12. The invention of claim 8 further comprising the additional steps of generating and propelling a sewage slurry.

13. The invention of claim 12 wherein the steps of generating and propelling a sewage slurry further comprise the steps of agitating and liquefying the sewage forwardly of the module.

14. The invention of claim 12 wherein the steps of generating and propelling a sewage slurry further comprise the steps of rending and withdrawing the sewage flurry rearwardly of the module.

15. The invneiton of claim 13 further comprising the steps of extracting and separating the slurry into sludge and liquid waste, thereby cleaning the sewage line section.

16. The invention of claim 15 further comprising the steps of returning the liquid waste to the sewage line section while retaining the sludge at the extraction and separation unit.

17. A method of cleaning a sewage line section comprising the steps of:

a) transporting and positioning a power unit, sewer cleaning module components, an extraction and separation unit, and a towing unit over and along a sewage line section;

b) lowering and assembling the sewer cleaning module components and thereafter connecting the sewer cleaning module to the power and towing units;

c) powering the towing the sewer cleaning module, thereby cleaning the sewage line section;

d) disconnecting, disassembling, and raising the sewer cleaning module components; and e) transporting and repositioning the power unit, sewer cleaning module components, extraction and separation unit, and towing unit over and above another sewage line section.

* * * * *